United States Patent [19]

Simpson

[11] Patent Number: 4,599,013

[45] Date of Patent: Jul. 8, 1986

[54] FIREPROOF BOOM

[75] Inventor: Wayne F. Simpson, Anchorage, Ak.

[73] Assignee: Shell Western E&P Inc., Houston, Tex.

[21] Appl. No.: 666,717

[22] Filed: Oct. 31, 1984

[51] Int. Cl.[4] ..... E02B 15/04

[52] U.S. Cl. ..... 405/72; 405/63

[58] Field of Search ..... 405/63–72; 210/923

[56] References Cited

U.S. PATENT DOCUMENTS

| | | | |
|---|---|---|---|
| 2,228,529 | 1/1941 | Moeller | 405/70 X |
| 3,628,665 | 12/1971 | Bakker | 405/71 X |
| 3,630,033 | 12/1971 | Tuttle | 405/71 |
| 3,651,647 | 3/1972 | Flariani | 405/72 X |
| 3,685,297 | 8/1972 | Juodis et al. | 405/68 |
| 3,695,042 | 10/1972 | Denison | 405/67 X |
| 3,868,824 | 3/1975 | Thurman | 405/72 X |
| 3,925,991 | 12/1975 | Poche | 405/65 |
| 4,065,923 | 1/1978 | Preus | 405/72 X |
| 4,388,188 | 6/1983 | Morris | 405/72 X |
| 4,537,528 | 8/1985 | Simpson | 405/63 X |

*Primary Examiner*—Dennis L. Taylor

[57] ABSTRACT

A fireproof boom for containing flammable pollutants on water includes a flotation member and at least two layers of heat-resistant, water-sorbent material surrounding the flotation member. The flotation member is a series of cylindrical metal cans held end-to-end by the heat-resistant material. The heat-resistant, water-sorbent material draws water around the heat-sensitive flotation member, forming steam in the presence of flaming pollutant and allowing only the outer layer of heat-resistant material to become slightly singed.

6 Claims, 2 Drawing Figures

FIG. 1
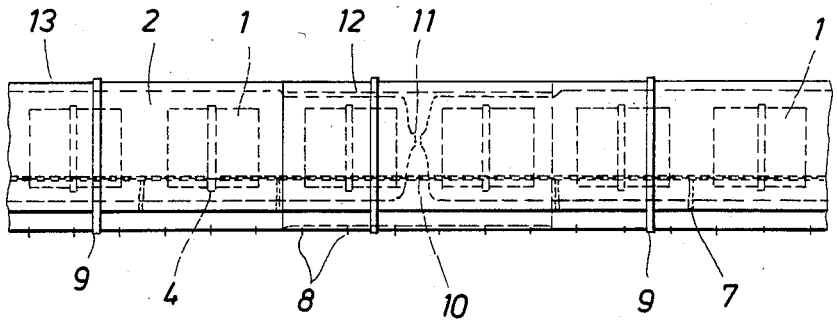
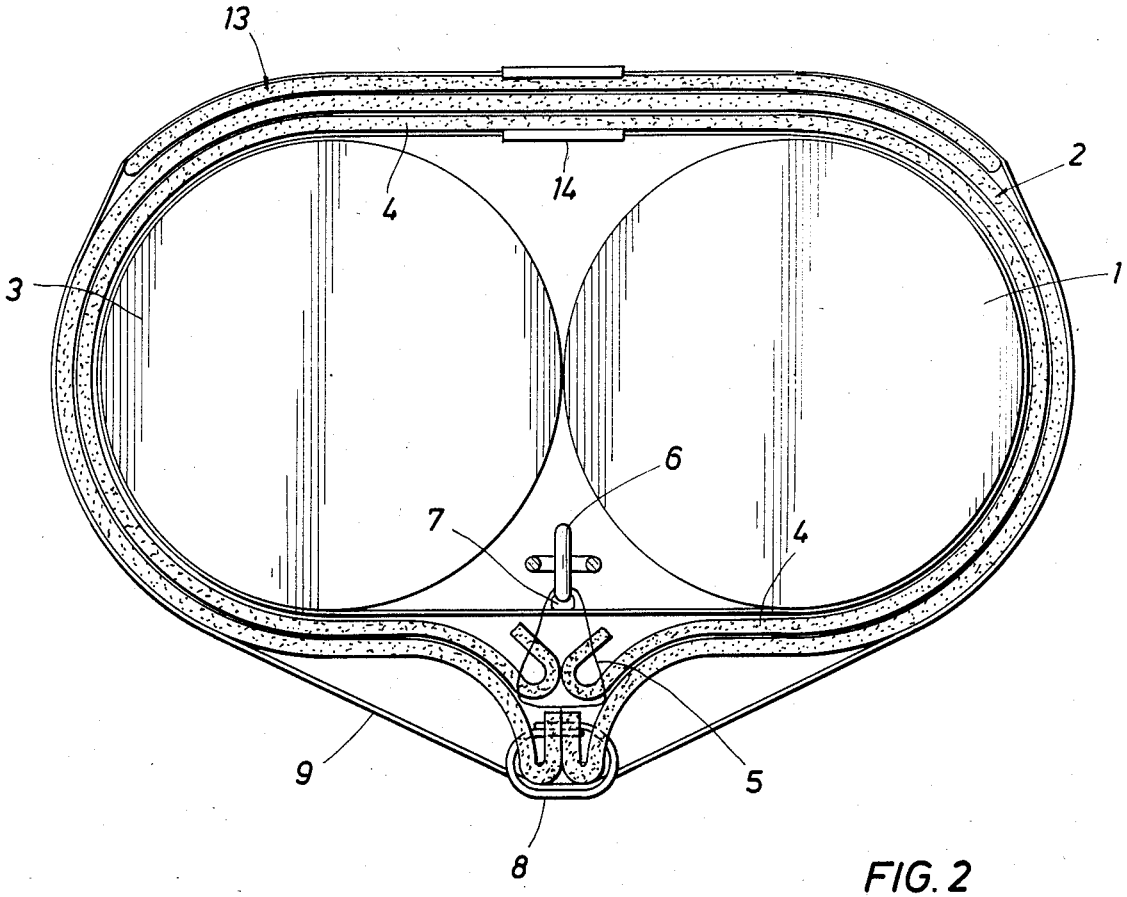
FIG. 2

FIREPROOF BOOM

BACKGROUND OF THE INVENTION

Booms are mechanical barriers which extend above and below the water surface and which are typically used to (1) enclose, contain, and concentrate spilled oil for recovery; (2) divert the oil to areas in which recovery is more easily conducted; and (3) safeguard commercially valuable or environmentally sensitive areas threatened by accidental spills or chronic pollution.

Although boom size, shape and materials vary widely according to the intended purpose of the boom, commercial booms generally consist of four basic components: (1) a means of flotation, such as a gas-filled compartment or solid float; (2) a freeboard section which extends above the water surface and prevents oil and debris from washing over the top of the boom; (3) a shirt which extends below the surface and keeps contained material from escaping beneath the boom; and (4) a tension member designed to withstand the forces of currents, waves, and winds.

Insitu burning of crude oil on water can be an extremely effective oil spill response, particularly in remote offshore areas and in broken ice where conventional countermeasures are limited. However, insitu burning is a problem insofar as the boom is concerned inasmuch as the boom may be destroyed or severely damaged by the fire. U.S. Pat. No. 4,062,191 discloses a boom wherein a fireproof fabric is utilized to reduce oil spill fire damage to the boom. However, it has been found that the temperature of burning crude oil adjacent to a boom may be at 1600° F. whereas a flameproof fabric such as cloth of woven glass fibers melts at 1100° F. and a foamed polypropylene flotation member melts at 330° F. Manifestly, more is required than simply a flameproof barrier to prevent damage to the boom.

Applicant is not aware of any other prior art which, in his judgment as one skilled in the boom art, would anticipate or render obvious the novel boom of the present invention; however, for the purposes of further developing the background of the invention and establishing the estate of the requisite art, the following art is set forth: U.S. Pat. No. 4,300,856. In addition, reference may be had to Applicant's copending application Ser. No. 520,873 filed Aug. 5, 1983, and to the art cited therein.

SUMMARY OF THE INVENTION

The primary purpose of the present invention is to provide a fireproof boom for containing a flammable pollutant on a water surface, which boom is capable of resisting the heat of adjacent burning pollutants and preventing significant damage to the boom itself. Preferably, the fireproof boom includes a flotation member and at least two layers of heat-resistant, water-sorbent material surrounding the flotation member, said materials generating steam when exposed to the high temperatures of the burning pollutant. The flotation member is a series of hollow chambers held together by the heat-resistant material. Preferably the hollow chambers are cylindrical metal cans.

Other purposes, distinctions over the art, advantages and features of the invention will be apparent to one skilled in the art upon review of the following.

BRIEF DESCRIPTION OF THE DRAWINGS

FIG. 1 discloses a side view of the boom according to the prevent invention.

FIG. 2 discloses an end view of the boom, revealing the multiple layers of heat-resistant barrier.

DESCRIPTION OF THE PREFERRED EMBODIMENTS

As above noted, insitu burning of crude oil in water is an extremely effective oil spill response, especially in remote offshore areas and in broken ice where known countermeasures are limited. Insitu burning can be enhanced in accordance with the present invention by containing and thickening the oil with fireproof or fire resistant barriers. The present invention provides a fire containment boom which is particularly suitable for such insitu burning.

The effectiveness of the present fire containment boom depends, in part, on the nature and amount of the oil involved, the wind, sea and ice conditions at the time of containment, and the type of platform (vessel, vehicle or aircraft) being used for deployment. During open-water conditions, the present boom can be deployed, positioned and maintained effectively from vessels. Helicopters can be used to transport the boom components to the spill site if necessary. The fire containment boom of this invention is capable of containing oil in winds, waves and currents which exceed the capacity of many conventional booms.

As ice concentrations increase, the present fire containment boom can still be used by allowing it to drift freely with the ice. If ice sizes and concentrations are such that a deflection booming cannot keep the fire containment boom free of the impact of the ice on performance, the drift mode can be used to prevent or reduce additional spreading within a heavily oiled ice field. The boom might also be positioned in a U-configuration so that wind might concentrate oil within it. As the accumulations build, pools of oil can then be ignited from the surface or from helicopters, etc. Ice concentrations well in excess of 50 percent necessitate flexibility and shallow draft. Both are features of the present boom which can be deployed on and within a heavily packed broken-ice field using helicopters, ice-strengthened tugs, etc. The present boom is used in such concentrations to supplement the existing natural containment of the ice itself.

A critical feature of the present boom is its ability to withstand extremely high temperatures of flaming pollutant, such as oil, which may burn at temperatures exceeding 1600° F., without damage to its flotation member which may be constructed of a hollow chamber or chambers which are susceptible to expanding and bursting with the heat. Accordingly, the present invention utilizes multiple layers of heat-resistant material such as cloth of woven glass fibers, commonly known as "thermoglass", which are wrapped about the flotation member of the boom and which may depend therefrom to form a skirt below the boom. The layers of heat-resistant material must draw water around the boom and maintain itself in a wettened condition. As the heat from the flaming pollutant contacts the outer layer of heat-resistant material, steam is formed inside the layers of heat-resistant material and prevents further penetration of the heat into the boom to cause damage. Even though the outer layer of heat-resistant material may be singed by the heat of the adjacent burning pollutant, inner layers are damage free. Inspection of these inner layers immediately after a test burning is conducted reveals evidence of the formation of steam therewithin. Accordingly, it is important in the construction of the present boom to use multiple layers of heat-resistant material and to so position the layers that they may perform an osmotic wicking action to draw water from the sea up into the layers of heat-resistant material and around the flotation member, thereby positioning the water to form protection steam about the flotation member.

Having thus generally described the apparatus and method of the present invention as well as its numerous advantages over the most relevant prior art, the following is a more detailed description thereof given in accordance with specific reference to the drawings.

FIGS. 1 and 2 show side and end views, respectively, of the invention. A boom comprises a number of boom sections as shown in FIG. 1. Each of the boom sections comprises at least one generally tubular element 1 and a cover 2. The flotation element 1 is preferably a series of chambers held end-to-end, for example cylindrical metallic cans. Less preferable, the flotation chambers can be of a non-metallic material, e.g., a heat-resistant plastic. More preferably, flotation element 1 also includes an adjacent series 3 of chambers. Alternatively, though less preferable, flotation elements 1 or 2 can be a single chamber. Cover 2 is a heat-resistant, flame-resistant, nonflammable or fireproof material. Preferably, material 2 is woven glass fibers, e.g., a cloth sometimes referred to as "thermoglass". While the material 2 may be mounted only on the side of the boom facing the pollutant spill, it is preferred for ease of construction and other convenience that the material 2 completely encircle the flotation 1 and/or 3. Flotation elements 1 and 3 preferably are secured together by lashing 14. A first layer of heat-resistant material 4 is secured with a lashing tie 5 to a tensioning member 6 such as a chain, which in turn is secured by lashing tie 7 to lashing 14. A second layer of heat-resistant material, i.e. cover 2 if only two layers are utilized, is secured with means 8, e.g. a hog ring. Finally, outside lashing 9 is used to secure outer cover 2. At least two layers of heat-resistant material are preferred, although it is apparent that additional layers could be used with even better results. Outer cover 2 of the flame-resistant material may extend downwardly to a skirt (not shown), although this is not necessary when two adjacent flotation elements (such as 1 and 3) are used. The tension member 6 can also double as a weighting member which stabilizes the boom.

FIG. 1 shows details of how boom sections are joined together. Tension element 6, if a chain, is joined with a double clevis link 10 at the joint. The inner fabric 4 is wrapped and tied at joints 11, and outer fabric 2 is overlapped at joints 12, which in turn are covered by a fabric 13 which is positioned lengthwise along the top of the boom.

The foregoing description of the invention is merely intended to be explanatory thereof. Various changes in details of described method and apparatus may be made within the scope of the appended claims without departing from the spirit of the invention.

I claim as my invention:

1. A fireproof boom for containing a flammable pollutant on a water surface comprising, a hollow flotation member susceptible to expanding and bursting with the application of heat, and at least two layers of heat-resistant, water-sorbent material surrounding the flotation member and extending into the water and functionable to perform an osmotic wicking action to draw water up into the layers of the heat-resistant material and around the flotation member, thereby positioning the water to form protective steam about the flotation member upon exposure of the boom to fire.

2. The boom of claim 1 wherein the flotation member comprises a series of hollow chambers held together end-to-end by the heat-resistant material.

3. The boom of claim 2 wherein the hollow chambers are cylindrical metallic cans.

4. The boom of claim 2 wherein the flotation member comprises two adjacent series of hollow chambers.

5. A fireproof boom for containing a flammable pollutant on a water surface comprising a flotation member of a series of cylindrical metallic cans held together end-to-end by a heat-resistant material which is water-sorbent, extends into the water and is functionable to perform an osmotic wicking action to draw water up into the layers of the heat-resistant material and around the flotation member, thereby positioning the water to form protective steam about the flotation member upon exposure of the boom to fire.

6. The boom of claim 5 wherein the flotation member comprises at least two adjacent series of metallic cans.

* * * * *